United States Patent [19]

Corner

[11] Patent Number: 5,056,239

[45] **Date of Patent: * Oct. 15, 1991**

[54] VACUUM DRYING MACHINE FOR TANNED SKINS, WITH MULTIPLE WORK SURFACES

[75] Inventor: Antonio Corner, Thiene, Italy

[73] Assignee: Officine di Cartigliano, Cartigliano, Italy

[ * ] Notice: The portion of the term of this patent subsequent to Jul. 23, 2008 has been disclaimed.

[21] Appl. No.: 416,385

[22] Filed: Oct. 3, 1989

Related U.S. Application Data

[63] Continuation of Ser. No. 306,201, Feb. 2, 1989, abandoned, which is a continuation of Ser. No. 127,296, filed as PCT EP87/00155 on Mar. 19, 1987, abandoned.

[30] Foreign Application Priority Data

Mar. 24, 1986 [IT] Italy ..... 85531 A/86

[51] Int. Cl.[5] ..... F26B 13/30

[52] U.S. Cl. ..... 34/92; 34/242

[58] Field of Search ..... 34/15, 92, 144, 145, 34/242, 146, 151, 155

[56] References Cited

U.S. PATENT DOCUMENTS

| | | | |
|---|---|---|---|
| 1,536,163 | 5/1925 | Sutherland . | |
| 1,854,341 | 4/1932 | Laussucq . | |
| 1,907,207 | 5/1933 | Laussucq . | |
| 3,126,578 | 3/1964 | Chapman | 34/145 |
| 3,438,137 | 4/1969 | Archer . | |
| 3,460,269 | 8/1969 | Kessler | 34/92 |
| 3,668,819 | 6/1972 | Henshaw . | |
| 4,480,990 | 11/1984 | Beam et al. | 34/144 |

*Primary Examiner*—Henry A. Bennett
*Assistant Examiner*—Denise L. Gromada
*Attorney, Agent, or Firm*—Wolf, Greenfield & Sacks

[57] ABSTRACT

The present invention relates to a vacuum drying machine for tanned skins, with multiple work surfaces, which comprises a fixed framework with at least two substantially vertical uprights which extend to the side of a plurality of vertically movable stacked platforms, each of which upwardly defines a work surface, and is provided below with a cover for the underlying platform. The vacuum drying machine is characterized in that at least one of the platforms is characterized in that at least one of the platforms is coupled to the movable liners of at least two linear double-action cylinders, each one being located at one of the uprights, the upper ends of the stems thereof being connected to the top of the matching upright.

19 Claims, 8 Drawing Sheets

3
44
43
52
51
57
54
48
44
43
53
48
44
43
54
44
48

VACUUM DRYING MACHINE FOR TANNED SKINS, WITH MULTIPLE WORK SURFACES

This application is a continuation of application Ser. No. 07/306,201, filed Feb. 2, 1989 which is a continuation of Ser. No. 127,296 filed as PCT EP87/00155 on Mar. 19, 1987 both now abandoned.

TECHNICAL FIELD

The present invention relates to a vacuum drying machine for tanned skins, with multiple work surfaces.

BACKGROUND ART

Vacuum drying machines are known which comprise a plurality of vertically movable superimposed platforms, each of which defines a work surface with its upper face, the skin or skins to be dried being laid thereon.

Except for the lowest one, each platform is provided, on its lower face, with a cover, the perimetral edge of which can be brought into sealing contact against the underlying work surface; the cover and the underlying platform thus provide, when joined together, an evaporation chamber in which the skins being treated are enclosed.

A cover is furthermore provided above all the platforms, and is also vertically movable or fixed to the framework of the machine, and cooperates with the work surface of the uppermost platform.

To dry the skins, the work surfaces are heated by appropriate heating means and a depression is provided inside the evaporation chambers by suitable aspiration means.

In known drying machines, the platforms and the eventual movable cover are usually moved vertically by pairs of hydraulic single-action cylinders, arranged at the uprights of the framework, provided to the sides of the platforms; each cylinder is provided with its liner fixed to the base of the framework and the upper end of its stem is fixed to a support which projects from the platform, supporting it from below.

Such a system for moving the platforms is however not devoid of disadvantages, among which the main one is that, in order to achieve the required operating strokes, very long cylinders must be used, with accordingly extended liners, which entail large dimensions and are difficult to accommodate inside the machine. It is thus sometimes impossible to keep the operating positions of the various platforms at correct heights, and the overall height of the machine reaches very high values.

Such disadvantages have led to the provision of drying machines wherein the lowermost platform remains fixed, and the level on which the operator acts to remove the dried skins and lay the skins to be dried varies each time; i.e., the work level varies from a minimum height, which matches that of the fixed height of the work surface of the lowermost platform, progressively increasing as platforms are stacked, up to a maximum increase equal to the thickness of all the platforms arranged stacked in a pack.

However, in order to perform these changes in level, it is necessary to provide the drying machine with a movable stand for the operator which shifts to the same height as the work surface one is operating at, thus significantly increasing the complexity of the machine and being detrimental to the practicality of the work of the personnel.

If, instead, it is intended to provide drying machines wherein the plane on which one operates is always at the same height, it is necessary to provide, moreover, the motion of the lowermost platform, and longer strokes for the motion of the other platforms. The dimensions and the bulk of the cylinders increase accordingly, and since the fixed work height cannot be lower than the level of the upper end of the liner of the highest cylinder, either the work height is increased excessively, and so is the overall height of the machine, or the cylinders must be made to project below the base of the machine.

However, this last solution is also not devoid of disadvantages, among which the most apparent are the need to provide beforehand a number of recesses on the resting surface, suitable for accommodating the projecting portions of the cylinders, and the practical impossibility of subsequently modifying the position of the machine.

Another disadvantage which sometimes occurs in known drying machines is that the hydraulic cylinders support the platforms from below and thus, being subject to the weight of the platforms, operate in compression. For this reason, when the cylinders are completely extended, the stems project by a great length and are coupled to the liner for a limited length, so that they are often subject to bending and, generally to undesired oscillations.

Another disadvantage of known machines is the particular kind of coupling which must be provided between the upper end of the stem and the supports projecting from the platform, in order to ensure adequate resistance and reliability, even with the small size of the coupling surfaces thus obtainable.

DISCLOSURE OF THE INVENTION

The main aim of the present invention is to eliminate the disadvantages described above in known types of drying machines with multiple work surfaces, by devising a drying machine wherein the platforms are moved so that besides allowing to keep constant the height of the work surface on which one operates, with the consequent advantage of the elimination of any movable stand or other equivalent accessory, it is possible to contain both the work height and the overall height of the machine, without providing downwardly protruding elements.

Within the scope of the above described aim, a particular object of the invention is to provide a system of movement wherein the coupling between the platforms and the framework of the machine makes the platforms furthermore subject to a self-centering action which makes them automatically assume the most appropriate position, adapting to any eventual irregularity in the guiding means, and being able to absorb without any disadvantage thermal variations produced e.g., by the variable heat status of the machine.

Another important object is to provide a device for moving the platforms which is provided with a simplified structure, wherein the component elements can be assembled quickly and without requiring constructive complications and is furthermore designed so as to facilitate transport, installation and any subsequent intervention on the machine, such as e.g. maintenance or replacement of components.

Not least object is to provide the drying machine with a system for moving the platforms which can be easily obtained starting from component elements commonly available on the market and which is furthermore competitive from an economic standpoint.

The aim described above, as well as the objects mentioned and others which will become apparent hereinafter, are achieved by a vacuum drying machine with multiple work surfaces for tanned skins, according to the invention, comprising a fixed framework with at least two substantially vertical uprights extending to the side of a plurality of vertically movable stacked platforms, each of which upwardly defines a work surface, and is provided below with a cover for the underlying platform, characterized in that at least one of said platforms is coupled to the movable liners of at least two linear double-action cylinders, each being located at one of said uprights the upper ends of the stems thereof being connected to the top of the matching upright.

BRIEF DESCRIPTION OF THE DRAWINGS

Further characteristics and advantages of the invention will become apparent from the description of four preferred, but not exclusive, embodiments, illustrated only by way of non-limitative example in the accompanying drawings, where.

WAYS OF CARRYING OUT THE INVENTION

Figure 1:
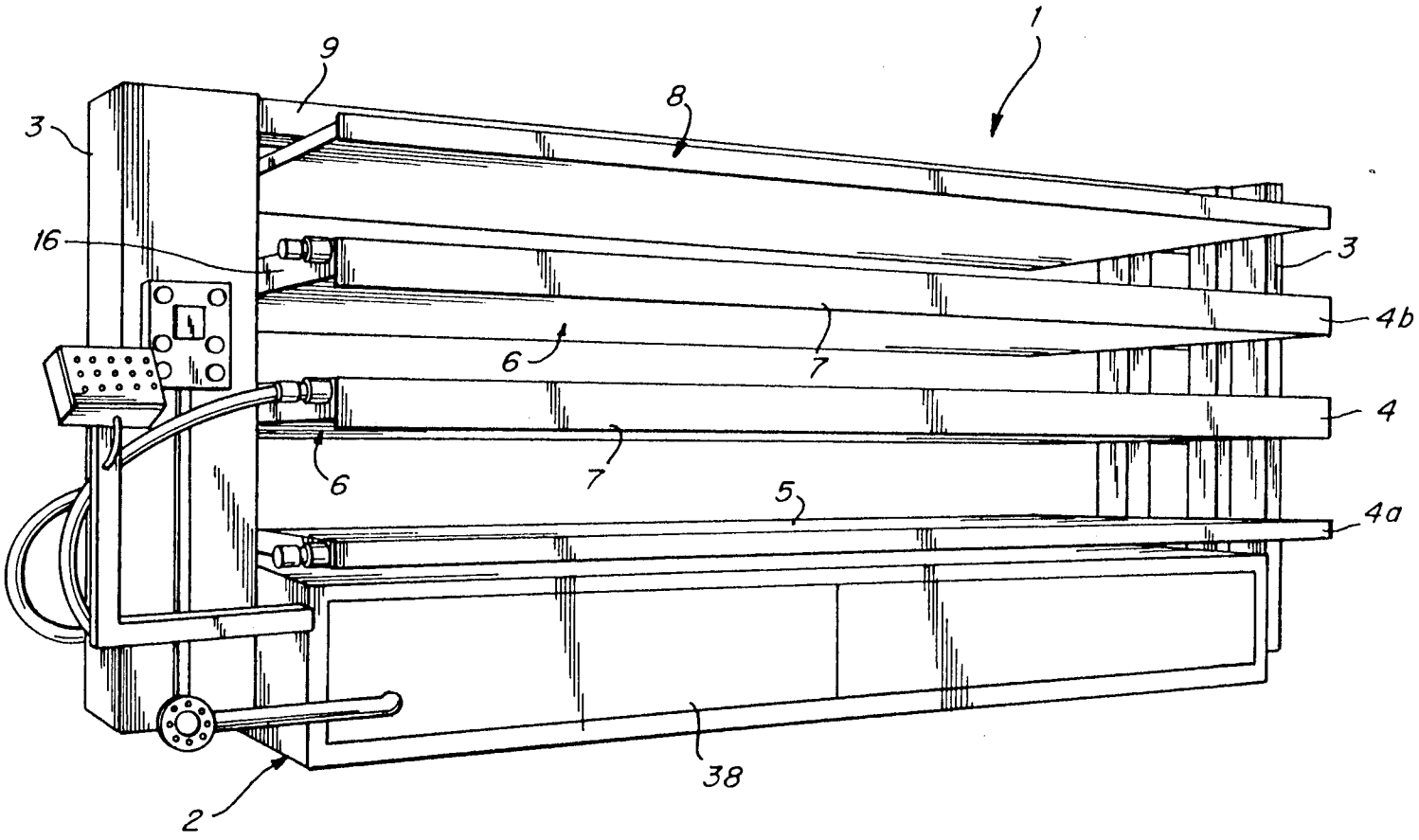
FIG. 1 is a perspective view of a vacuum drying machine with multiple work surfaces.

With reference to the figures, a vacuum drying machine with multiple work surfaces for tanned skins, generally indicated with the reference numeral 1, comprises a framework which is provided laterally with a pair of vertical uprights 3, between which a plurality of platforms 4 extends, which platforms are stacked and arranged in horizontal planes, which are vertically movable, both independently and in mutual cooperation.

Each platform 4 defines, with its upper face 5, a work surface on which the skin or skins to be dried are laid.

With the exception of the lowermost platform, which is indicated by the reference numeral 4*a*, the remaining platforms 4 are provided, applied to the lower face, with a cover 6, or with another equivalent element, provided with circumferential borders 7 capable of sealingly coupling to the work platform 5 of the underlying platform, defining a sealed evaporation chamber which operates in depression, wherein the skin or skins, which are being dried, are enclosed.

Figure 3:
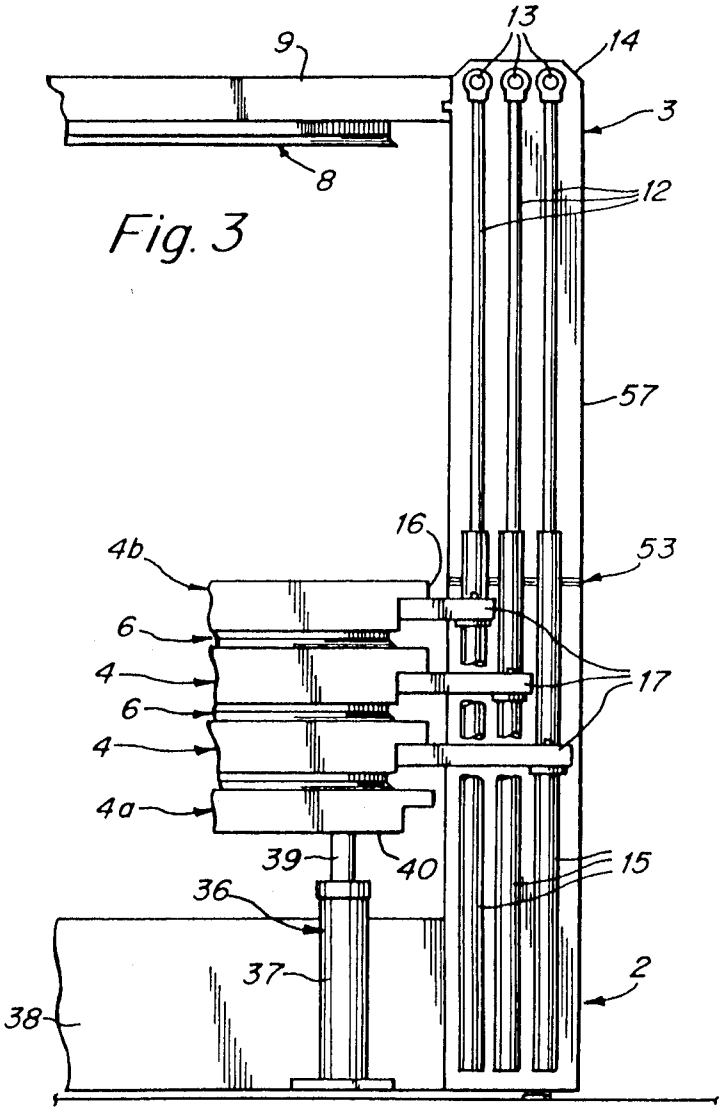
FIG. 3 is a view similar to the one of FIG. 2, which illustrates the opposite lateral portion with the platforms stacked in a pack.
Figure 2:
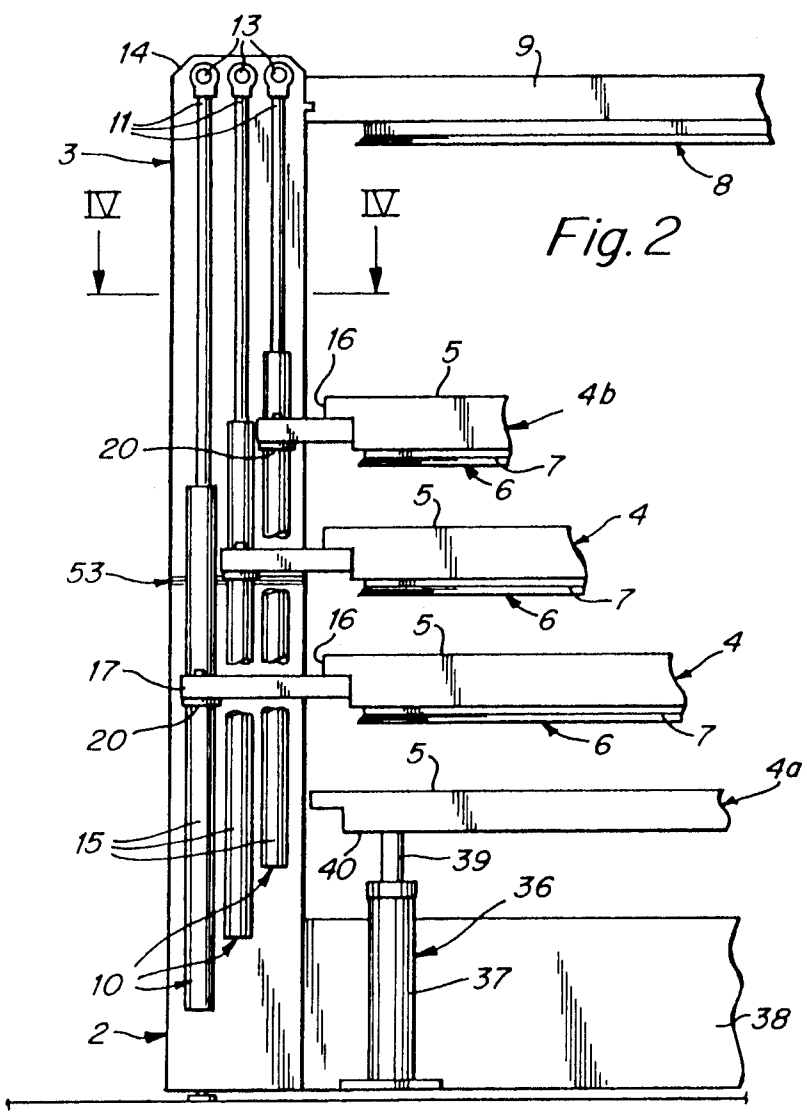
FIG. 2 is a schematic front view of a partially cutout lateral portion of a first embodiment of a drying machine according to the invention, illustrated with the platforms spaced apart.
Figure 9:
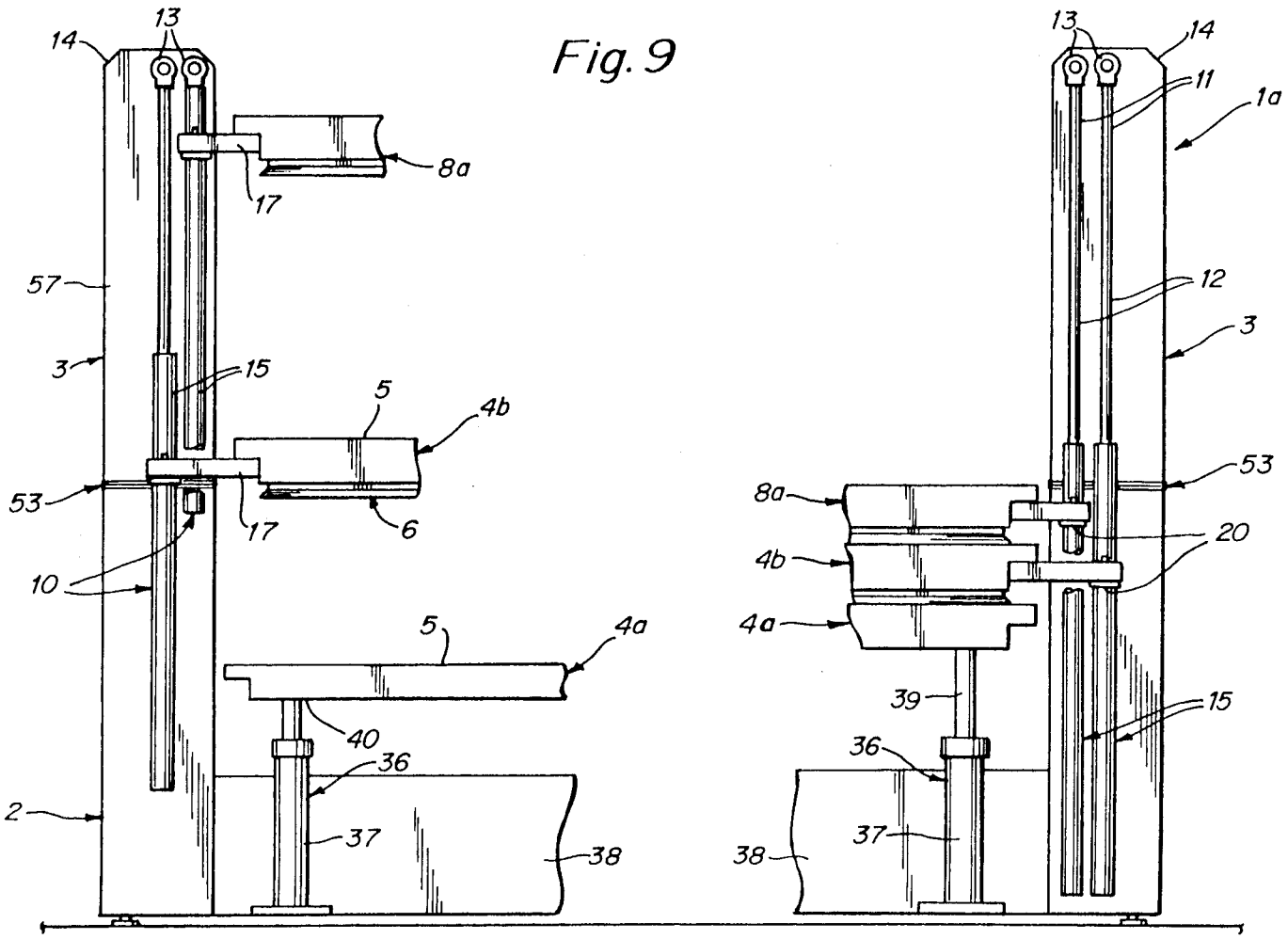
FIG. 9 is a schematic lateral view, partly in cross section, of a second embodiment of a drying machine according to the invention, with two platforms and with a movable upper cover, illustrated respectively with the platforms and the cover spaced apart and stacked in a pack.

An upper cover 8, suitable for cooperating with the work surface of the upper platform, indicated with the reference numeral 4*b*, is provided above all the platforms 4 and can be fixed, as in the example illustrated in FIGS. 1 to 3, supported by an upper framework 9 which connects the two uprights 3 to each other, or also vertically movable to follow the movements of the underlying platform 4*b*, as illustrated in FIG. 9 related to a two-platform drying machine, indicated with the reference numeral 1*a*.

Each platform 4 is provided with means for heating the skins laid on the work surface 5 and is associated to a circuit for the condensing of the vapors released by the skins; aspirating means are furthermore provided, such as, e.g., a vacuum pump for each platform 4 or a single pump for all the platforms, which means generate a depression within the evaporation chambers so as to facilitate and accelerate the drying of the skins contained therein.

In order to provide a preset working cycle during which each cover, 6 or 8, remains engaged for a preset period against the underlying work surface 5, moving away therefrom when the drying action is complete to allow the extraction of the dried skins and the insertion of new skins to be processed, so that the work surface affected by the skin replacement operation is always positioned at the same height, all the platforms 4, including the lowermost one 4*a*, and eventually also the upper cover 8 (see FIG. 9), are vertically movable, operated by a vertical movement device.

According to the present invention, said vertical movement device comprises pairs of double-action linear cylinders, such as the double-action hydraulic cylinders 10, which are arranged at the two uprights 3 and are provided with the upper end 11 of their stems 12 suitably coupled by spherical joints 13 to the top 14 of the respective upright 3.

The liners 15 of the cylinders 10 thus hang from the respective stem 12 and are vertically movable.

The platforms 4, with the exception of the lowermost platform 4*a*, have their shorter sides 16 connected to the liners 15 of the various pairs of cylinders 10. It should be noted, in any case that while the upper platform 4*b*, or the upper cover 8 if movable, couples to the liners 15 proximate to the upper edge thereof, the underlying platforms 4 are connected to the liners 5 in regions at increasing distances from the matching upper edges; in practice, the distance from the upper edge of the liners 15 to the coupling region of the platforms 4 increases for the progressively underlying platforms by a value equal to the thickness of said platforms, so that when the cylinders 10 are completely extended, as illustrated in FIG. 3A, all the platforms are consequently stacked in a pack, while, vice versa, when the cylinders 10 are completely retracted, all the platforms are joined to each other and to the upper cover 8.

Appropriately, the cylinders 10 are aligned along the longitudinal axis of the platforms 4 and the upper platform 4*b* is connected to the innermost pair of hydraulic cylinders 10, the underlying planes 4 being progressively coupled to the progressively outer pairs of cylinders 10.

More in detail, two parallel arms 17, arranged symmetrically with respect to the longitudinal axis, extend from the shorter sides 16 of the platforms 4, operated by the double-action cylinders 10, and reach the respective cylinder 10 and are coupled, e.g. by means of bolts 18 to the lateral portions 19 of an horizontal plate 20 which is rigidly coupled to the liner 15.

Figure 5:
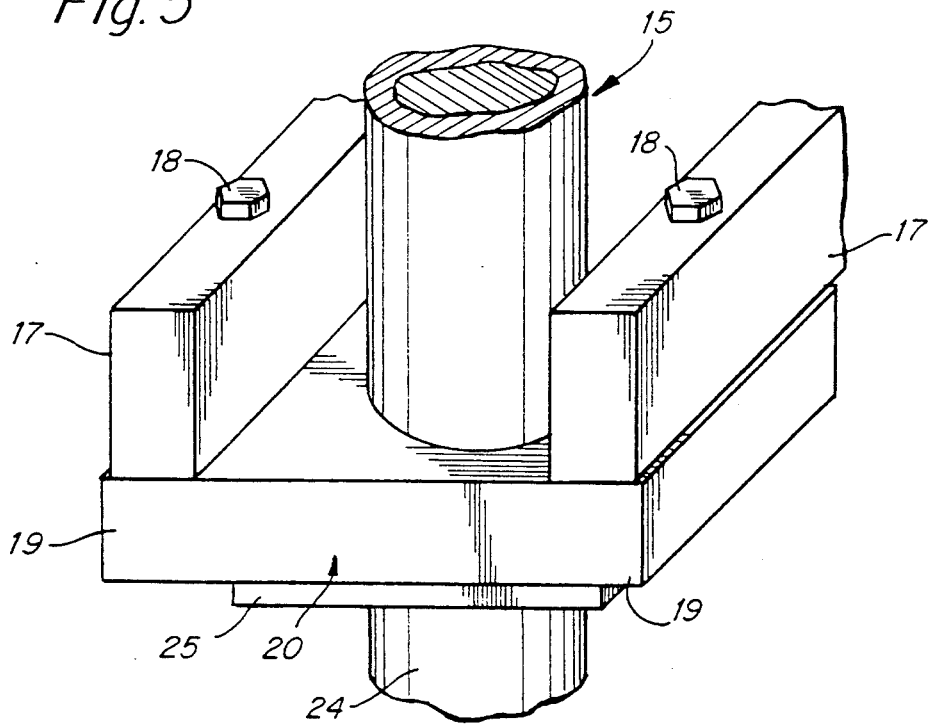
FIG. 5 is a perspective view of a detail illustrating the coupling of the platforms to the respective liners.
Figure 6:
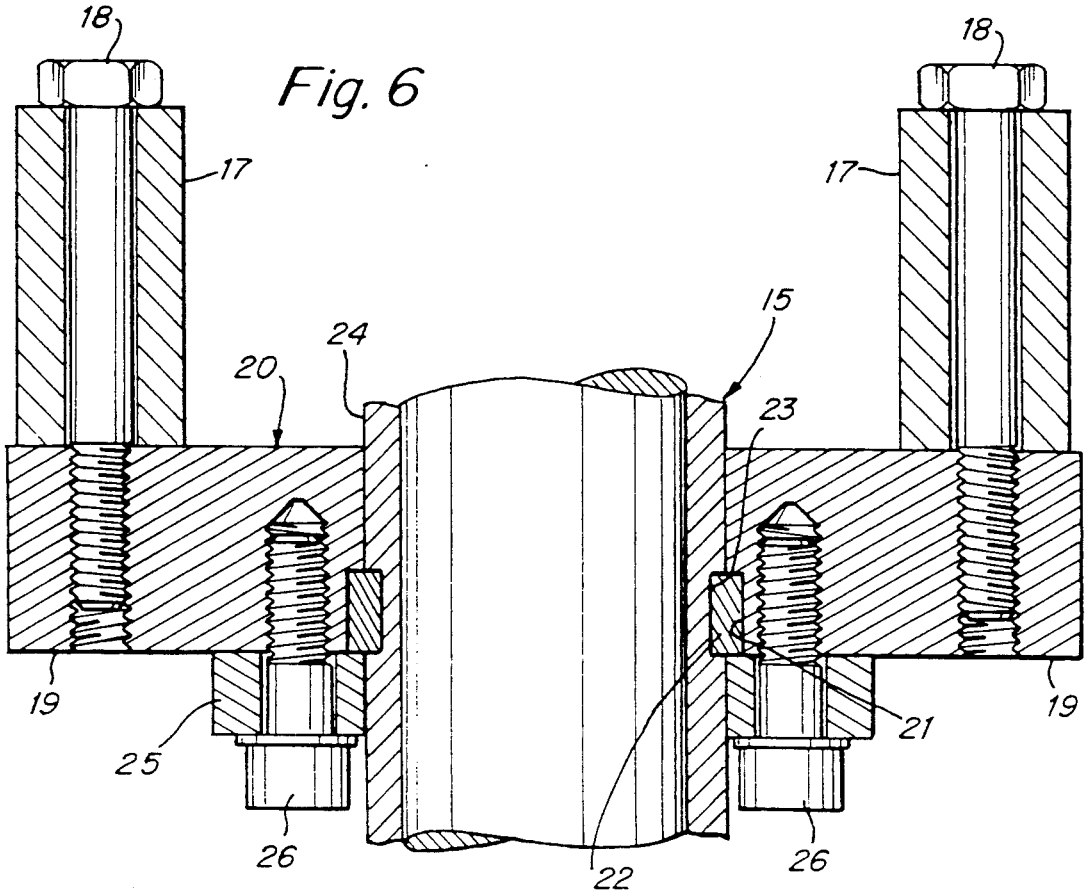
FIG. 6 is a vertical cross section view along the axis of a linear cylinder related to the coupling illustrated in FIG. 5.

As is better illustrated in FIGS. 5 and 6, the plates 20 are removably fixed to the liner 15, since each plate 20 is provided with a central hole which, being traversed by the respective liner 15, is provided with a lower lateral region 21 which is larger in diameter and couples with an arrestor abutment rigidly coupled to the liner 15; said arrestor abutment is suitably composed of the circumferentially protruding crown of a ring 22 which can be split, e.g., into two half-rings, and is accommodated in a matchingly shaped annular groove 23 provided on the outer surface 24 of the liner 15.

The sliding of the plate 20 along the liner 15 is suitably prevented by a drilled plate 25 which, on the opposite side with respect to the plate 20, engages against the ring 22 and is coupled to the same plate 20 by appropriate securing means, such as screws 26.

Figure 7:
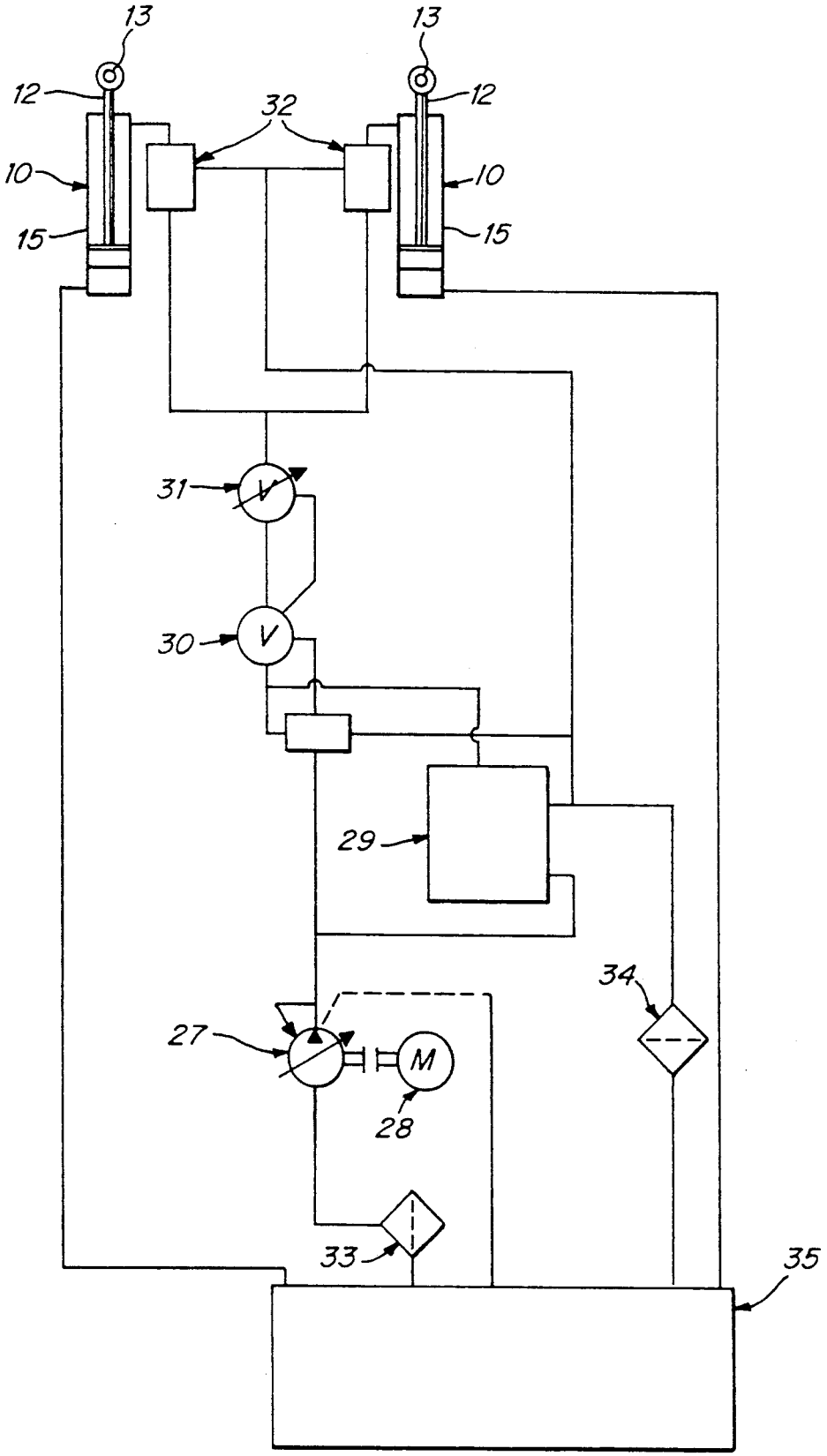
FIG. 7 is a diagram of a part of the hydraulic system which controls a pair of cylinders associated to a same platform.

As illustrated in FIG. 7, which schematically illustrates a part of the hydraulic circuit preferably used, each pair of double-action cylinders 10, coupled to the same platform 4 or 4*b* or to the upper cover 8 if said cover is also vertically movable (see FIG. 9), is operated in a synchronized manner by means of a separate volumetric pump 27, e.g. of the piston type and preferably with a variable flow rate, with full zero setting, mechanically coupled to an electric motor 28.

An hydraulic safety device 29 is suitably inserted on the hydraulic circuit which connects the pump 27 to the respective cylinders 10, and comprises: a reducing valve which reduces the pressure of the hydraulic liquid between the primary circuit, where e.g. approximately 130 bar may occur, and the secondary circuit, where again approximately the pressure may be around 20 bar; a safety valve; a sequence valve which, hydraulically driven by the secondary circuit, activates the primary circuit only when the pressure of the secondary circuit reaches the required value and conversely inhibits the motion of the platforms 4 if the pressure in the secondary is not at the optimum value, e.g. due to tampering or to a malfunction of the reducing valve.

An electric valve 30 is furthermore provided on the hydraulic circuit, and controls the automatic operation of the machine, and so is an adjustment valve 31 which, by allowing to modify the flow rate of hydraulic fluid, allows to adjust the speed of descent of the platforms 4.

In the circuit of FIG. 7 it is moreover possible to identify the safety blocks 32, and the aspiration filter 33 and discharge filter 34 arranged at the tank 35 of the hydraulic liquid.

It should be furthermore noted that, during the ascent of a platform 4, the secondary circuit sends in any case into the upper chamber of the related cylinders 10 a low-pressure flow of the hydraulic liquid, so as to always keep said upper chamber filled, even if the platform moves, e.g. in the conditions of depression vacuum, when raised due to the ascent of the underlying platforms 4.

Besides the hydraulic safety device 29 already described, the hydraulic circuit is furthermore provided with an electric safety device, composed of a pressure switch on the secondary circuit, which blocks the motion of the platforms 4 if for any reason the hydraulic driving pressure in said secondary circuit should be lost; the electric safety device thus performs electrically the same function also performed by the safety valve.

As already mentioned, the lowermost platform 4*a* is not operated by the double-action cylinders 10 but is instead suitably supported and shifted, in the embodiments illustrated, by a pair of single-action cylinders 36 which, arranged below it, are provided with fixed liners 37 arranged as a base 38 for the framework 2, from which liners movable stems 39 extend and engage with the lateral regions 40 of the lowermost platform 4*a*.

The vertical motion of the platforms 4 may be guided by suitable guiding means provided on the framework 2, so that the platforms 4 move vertically and keep exactly parallel to themselves.

Figure 4:
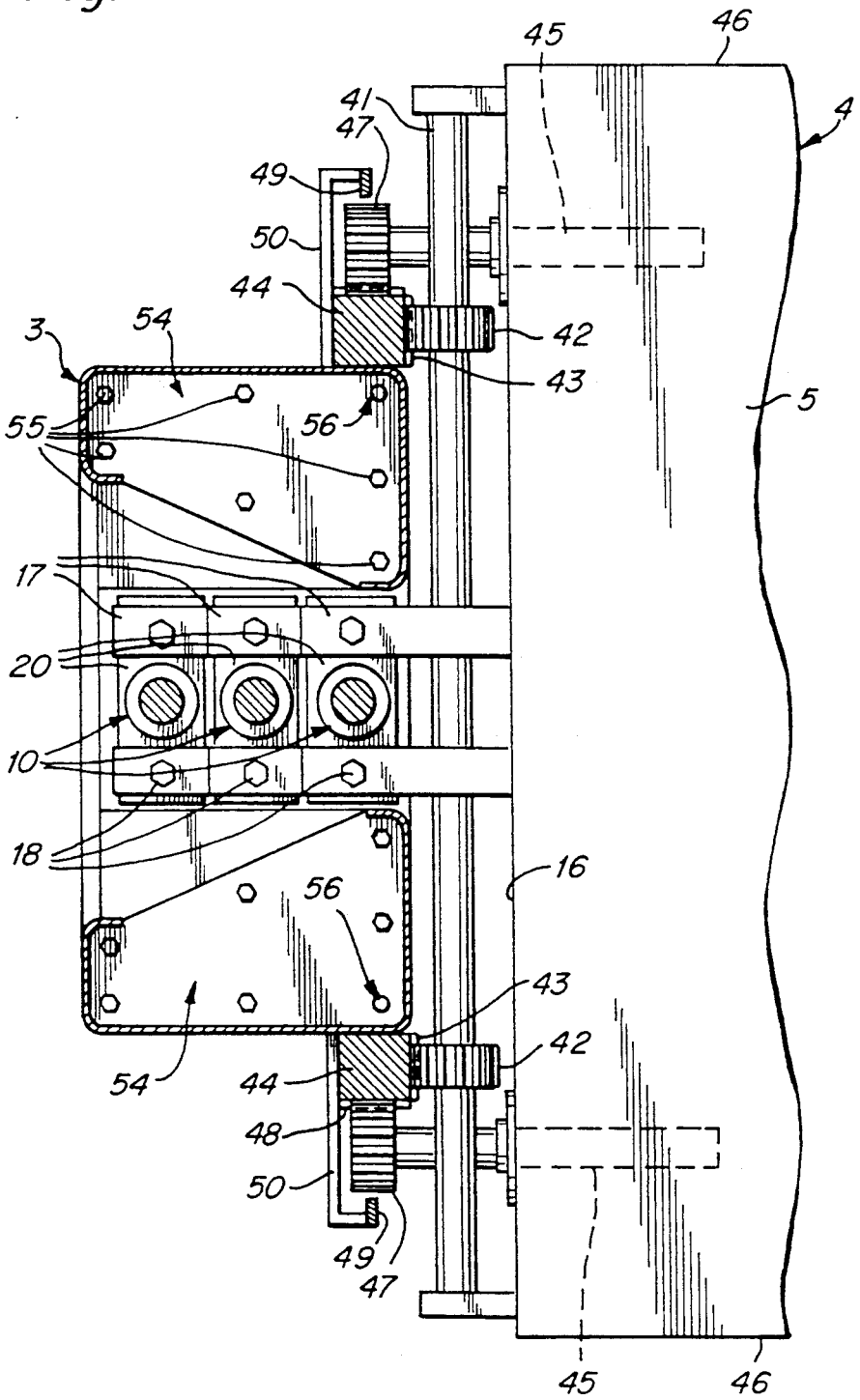
FIG. 4 is a transverse cross section view, performed along the line IV—IV of FIG. 2, illustrating the guiding means and the electric safety device which control the motion of the platforms.

In the embodiments illustrated, and as pointed out in FIG. 4, said guiding means comprise a pair of transverse shafts 41, mounted freely rotatable on the shorter sides 16 of all the platforms 4 and eventually also of the upper cover 8, if movable; the transverse shafts 41 are provided at each end with a pinion 42 which engages with a complementary front set of teeth 43 of a double vertical rack 44 fixed to the uprights 3.

The guiding means furthermore comprise a pair of longitudinal shafts 45, mounted freely rotatable on the longer sides 46 of all the platforms 4 and eventually of the upper cover 8; the longitudinal shafts 45 are also provided with toothed end wheels 47 which engage in the complementary lateral teeth 48 of the double rack 44.

The motion of the platforms 4 is furthermore controlled by a safety device which is preferably composed of bars 49 which, supported in an electrically insulated manner by the related supports 50 extend parallel to the lateral teeth 48 at such a distance as to allow the exact passage of the toothed wheels 47.

When, for any reason, a platform 4 or the movable cover 8 tend to arrange themselves on a non-horizontal plane, one of its toothed wheels 47 touches the bar 49, closing an electric contact which causes the halting of all the movements of the machine.

Figure 8:
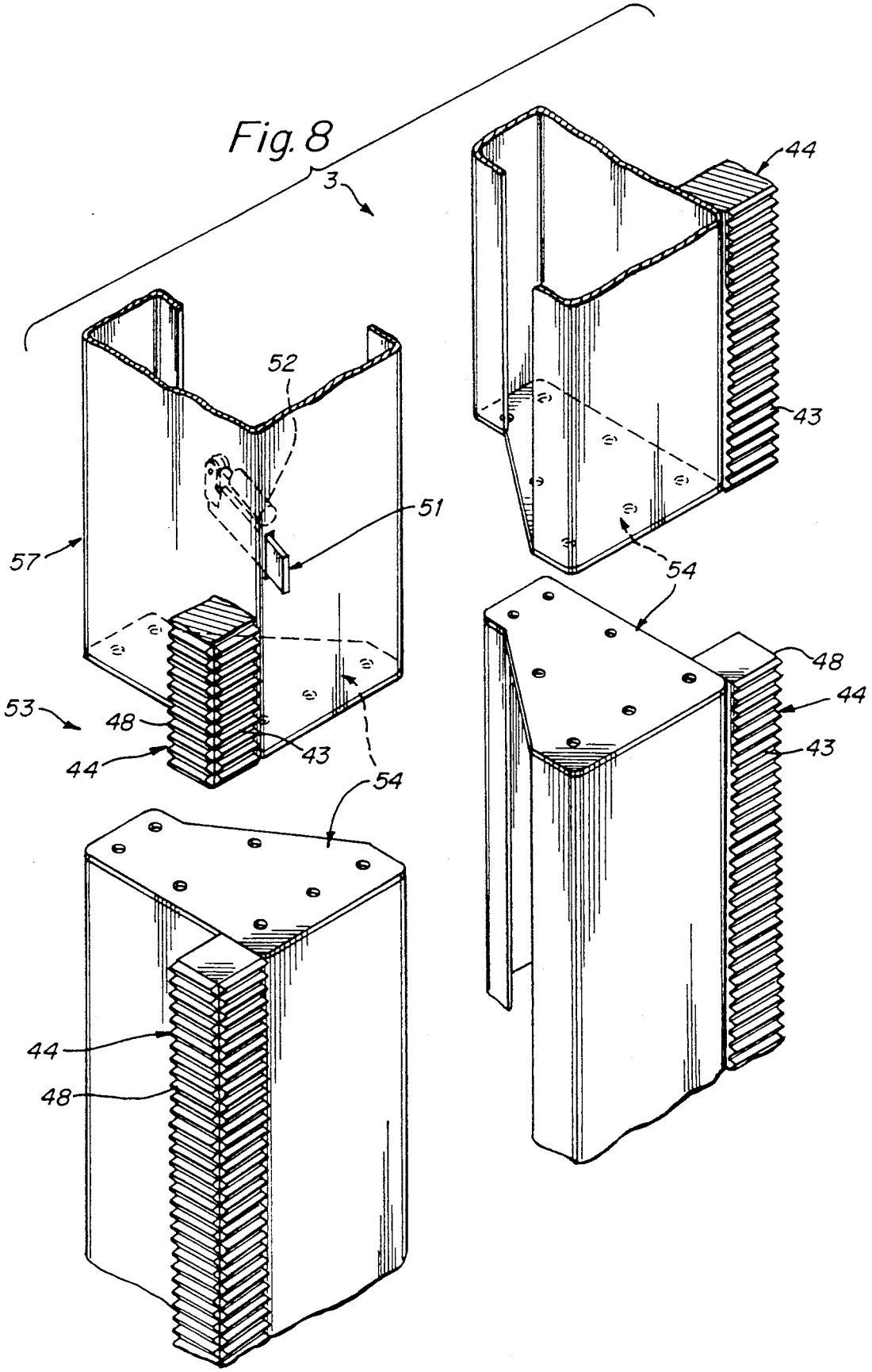
FIG. 8 is a detail of a perspective view illustrating the embodiment of the uprights, which can be dissassembled.

Mechanical safety devices are furthermore provided on the uprights 3, which devices, as illustrated in FIG. 8, are composed of pairs of bolts 51, arranged diagonally on the opposite sides of the two uprights 3, which are capable of supporting the entire weight of all the platforms 4 and of the eventual movable cover 8; the bolts 51 are operated by actuators 52, e.g. hydraulic or pneumatic, which alternately cause the reentry of said bolts 51, to allow the passage of the movable elements, and subsequently make the bolts 51 protrude from the uprights 3 until they project below the platforms 4, to block their descent in case of sudden severe breakdown.

From what has been described, the operation of the supply system of the platforms 4 is evident and can be summarized as follows.

The pairs of double-action hydraulic cylinders 10 are suspended from the top 14 of the uprights 3 and support and move the related platforms 4, 4*b* and, eventually, the upper cover 8 connected thereto.

In particular, when the hydraulic circuit sends, via its primary circuit, hydraulic liquid into the upper chambers of the cylinders 10, the liners 15 rise and raise the platform; the weight of the elements supported will conversely make the liners 15 descend when the pressure in the primary circuit ceases, thus making the platforms, and the eventual upper movable cover 8, descend at a rate preset by means of the adjustment valve 31.

The platforms 4 can thus move separately and spaced apart, or keeping one or more covers 6 in contact with the respective work surface 5, so as to keep operative the evaporation chamber provided thereby.

The operation of the system may be controlled either manually, or in a semiautomatic or automatic manner, e.g. with preset work cycles; validation switches can be furthermore provided which follow the execution of all the various phases of the work cycles, requiring, to start a new type of work at the end of the preceding one the operation, on the part of the operator, of a suitable control means, such as, e.g., a pedal, a pushbutton or the like.

The coupling of the platforms 4 to intermediate regions of the liners 15, with the stems 12 suspended from the top 14 of the uprights 3, allows to provide long strokes for said platforms, since it is possible to bring the work surfaces 5 to a limited height from the ground, so as to be able to arrange the work surface affected by the replacement or the loading of the skins always at the same level. This occurs without the need to increase the overall height of the machine 1 or to make use of upwardly or downwardly protruding pistons.

The coupling of the stems 12 by means of the spherical joints 13 allows a certain freedom of motion to the platforms 4 which, being subjected to the action exerted by their own weight, have self-centering characteristics which make them arrange spontaneously in the most appropriate position, and furthermore allows them to adapt to eventual imperfections of the guiding means and not to be affected by differential deformations due to different thermal expansions of the various parts of the machine.

Another important advantage featured by the drying machine described lies in that it is possible to provide the two uprights 3 so that they might be disassembled, by means of a removable connection 53, by providing, e.g. as illustrated in FIG. 8, approximately halfway along the height of the uprights 3, two flanges 54 joined by bolts 55 and coupled, at the racks 44, by centering pins 56.

This moreover allows, after the complete assembly and testing of the machine 1 at the manufacturer's works, to have all the platforms 4 descend in a stack, together with the upper lid 8, after having uncoupled it from the framework 9 making it rest on the uppermost platform **4*b*, and to disconnect all the upper ends 11 of the stems 12 from the spherical joints 13 since the entire assembly is supported by the lowermost platform 4*a***.

The possibility is thus evident of separating the upper part 57 and the uprights 3 and of transporting more easily the components thus disassembled, which have a much smaller height than the entire machine; during the installation of the machine, it will be easy to proceed with the reverse operations to quickly assemble the complex.

Remarkable and evident advantages are thus obtained with respect to the transport, at the same time solving the problems which arise when the machine 1 is to be moved through passages, such as e.g. main doors of tanneries, inner low trusses which are lower than the overall height of the machine 1 when assembled.

It should be furthermore noted that the possibility of moving vertically the lowermost platform **4*a* facilitates the access to the lower face of the platform 4*a* itself and to the inner components of the framework 2, thus simplifying many interventions, such as e.g. replacement or maintenance in general, which have to be performed on the machine 1**.

The coupling of the platforms 4 to the liners 15, though it offers the greatest assurances of reliability and safety, is structurally very simple, easy to assemble and disassemble, and does not feature any particular difficulties in embodiment, as it merely requires the preparation on the liners 15 of the annular grooves 23, which can be easily obtained, e.g., with a turning operation.

Moreover, the system of movement which is the object of the invention uses elements, such as the linear double-action cylinders 10 or the spherical joints 13, which are available on the market, thus avoiding the design and the production of specific particular elements, with consequent benefits from the economical point of view.

The invention thus conceived is susceptible to numerous modifications and variations, all of which are within the scope of the inventive concept.

Figure 10:
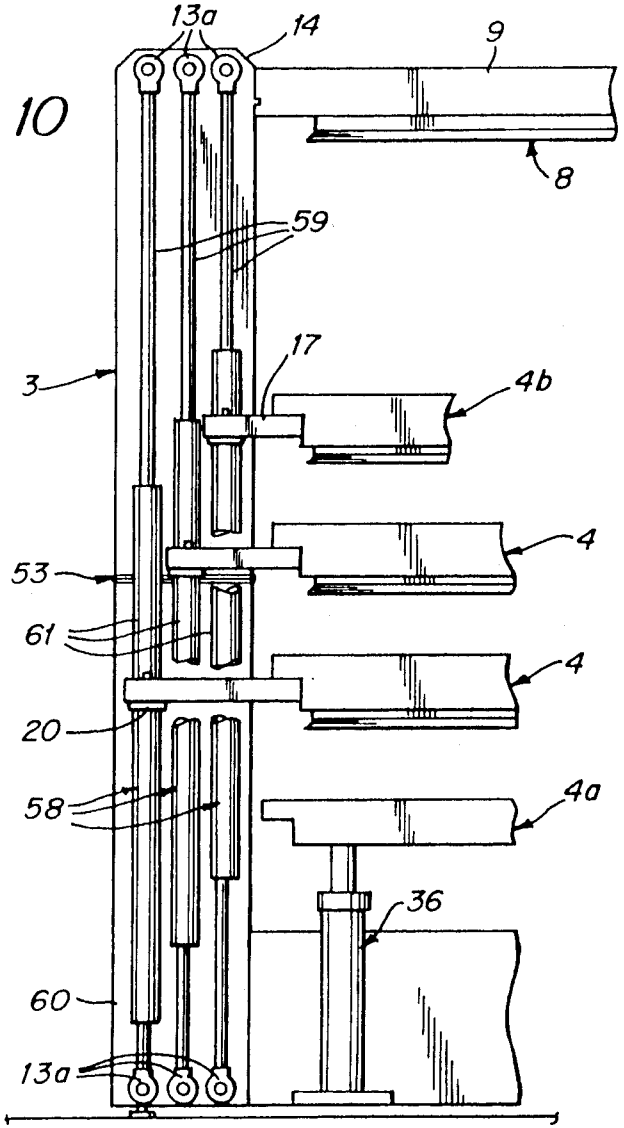
FIG. 10 is a schematic, partial cross section view of a lateral portion of a third embodiment of a drying machine according to the invention.

Thus, as an example, according to a third embodiment, illustrated in FIG. 10, the linear double-action cylinders are composed of hydraulic cylinders 58 with a through stem 59. Their stem 59 extends for the entire length of the uprights 3 and is fixed, appropriately by means of pairs of spherical joints **13*a*, respectively to the top 14 and to the base 60 of the uprights 3**.

Also in this third embodiment, the liners 61 of the cylinders 58 are vertically movable and are coupled, similarly to what has been illustrated in FIGS. 5 and 6, to the smaller sides 16 of the platforms 4.

Figure 11:
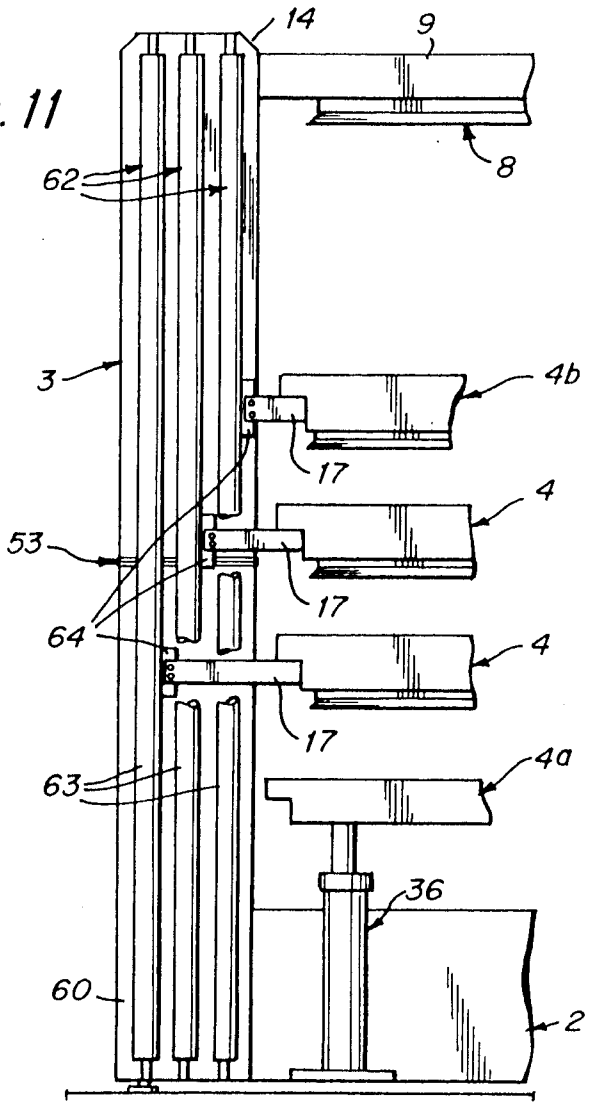
FIG. 11 is a view, similar to the previous one, illustrating a fourth embodiment of a machine according to the invention.

According to a fourth embodiment, illustrated in FIG. 11, stemless linear double-action cylinders 62 are instead provided, which comprise a tubular element 63 inside which a cylindrical piston is slideable and defines two inner sealed chambers and is rigidly connected to a bracket 64 which projects out of the tubular element 63, through a sealing device composed of two steel bands or of another suitable apparatus which allows the sealing thereof.

According to the invention, the stemless cylinders 62 are arranged within the uprights 3 fixed both at the top 14 and to the bottom 60, and their bracket 64 is connected to the shorter side 16 of the platforms 4.

Similarly to what has been illustrated in FIG. 9, also in these embodiments the upper cover 8 may be eventually vertically movable, so as to be able to follow the movements of the upper platform **4*b***, it too being operated, e.g., by a matching pair of linear cylinders according to the invention, or by known kinds of moving devices.

The lower platform **4*a* may also be operated by a pair of double-action linear cylinders, according to the invention, or also, according to a further different embodiment, it may be suspended to cables which, wound on return pulleys placed e.g. at the top 14 of the uprights 3**, are connected to counterweights.

The device which moves the lowermost platform **4*a*, in this last case, will be provided so that the lowermost platform 4*a*** is raised by the counterweights up to the common work height, while its descent occurs by virtue of the thrust produced by the descent of the overlying platforms.

Furthermore, all the details, which may be replaced by other technically equivalent elements, and in practice the materials employed, so long as compatible with the contingent use, as well as the dimensions, may be any according to the requirements and to the state of the art.

I claim:

1. Vacuum drying machine for tanned skins with multiple work surfaces, comprising:

a fixed framework formed from at least a pair of substantially vertical uprights each having a top, a mounting base and vertical guide means;

a plurality of substantially horizontal elongated platforms having longitudinal axes, longitudinal sides and transverse sides, each platform being arranged for vertical movement along said guide means;

each of said platforms defining an upper work surface for supporting a skin to be treated and a lower face having a cover for sealingly engaging with an underlying adjacent platform to define a drying chamber;

heating means arranged within said platforms for heating the skins to be dried;

suction means connected to each platform to provide a vacuum within said chamber;

a plurality of double-acting hydraulic cylinders each having a liner and a stem, at least one of said platforms being coupled to at least one pair of said cylinders, said at least one pair of cylinders adapted to move vertically said at least one platform relative to said framework;

said plurality of cylinders have movable liners and stationary stems having upper free ends and connecting joints provided at the upper free end of said stems to suspend the cylinder downwardly from the top of a corresponding vertical upright, said at least one platform being coupled to the movable liners of said at least one pair of cylinders at a predetermined level accessible to an operator with said pair of cylinders in a fully extended condition.

2. Vacuum drying machine according to claim 1, wherein said connecting joints are spherical joints providing self-centering of the supported platform.

3. Vacuum drying machine according to claim 1, wherein an upper cover is located above the uppermost platform of said plurality.

4. Vacuum drying machine according to claim 3, wherein said cover is movable.

5. Vacuum drying machine according to claim 3, wherein said cover is stationary.

6. Vacuum drying machine according to claim 1, wherein said liners have upper edges, the platforms being connected to the movable liners of respective pairs of cylinders at regions of said liners located at predetermined distances from said upper edges.

7. Vacuum drying machine according to claim 6, wherein said predetermined distances are progressively increasing from the upper to the lower platforms by a value equal to the thickness of each platform to permit positioning of the upper working surface of each platform at said predetermined level accessible to the operator, and to provide a pack-line stacking of a predetermined number of platforms with the corresponding cylinders in both fully extended and fully retracted conditions.

8. Vacuum drying machine according to claim 1, wherein said cylinders are substantially aligned with the longitudinal axes of said platforms, each pair of cylinders coupled to a respective platform being located externally of the pair of cylinders coupled to the overlying platform.

9. Vacuum drying machine according to claim 3, wherein each platform is provided with a pair of substantially horizontal arms extending symmetrically to the longitudinal axis said platform from the transverse sides thereof, said liners being provided with securing means rigidly coupled with said pair of arms.

10. Vacuum drying machine according to claim 9, wherein said securing means are substantially horizontal plates each having a central through hole for the passage of a respective liner, each liner having an arrestor abutment rigidly coupled thereto, said central hole defining a lower region with a larger diameter adapted to abut against said arrestor abutment.

11. Vacuum drying machine according to claim 1, wherein each pair of said double-action hydraulic cylinders, coupled to one of a said platforms and a movable upper cover, is simultaneously operated by a hydraulic circuit including a volumetric pump with variable flow rate and full zero setting.

12. Vacuum drying machine according to claim 3, wherein said hydraulic circuit comprises control valves adapted to feed the pair of cylinders of each platform upon lowering thereof with hydraulic liquid at low pressure responsive to the lowering of one or more underlying platforms whereby the upper chambers of said cylinders are continuously repleted.

13. Vacuum drying machine according to claim 1, wherein said guide means comprise a vertical rack fixed to each upright, said rack having a first transverse toothed side and a second longitudinal toothed side.

14. Vacuum drying machine according to claim 13, wherein a first pair of shafts is journalled to each platform parallel to the transverse sides thereof, said first pair of shafts having at each end thereof a pinion in meshing engagement with said first toothed side of said vertical rack.

15. Vacuum drying machine according to claim 14, wherein a second pair of shafts is journalled to each platform parallel to the longitudinal sides thereof said second pair of shafts mounting at the ends thereof, toothed wheels in meshing engagement with said second side of said vertical racks.

16. Vacuum drying machine according to claim 1, wherein each upright comprises an upper and a lower section, each section having at one end thereof a connecting flange arranged for releasable coupling with the other connecting flange.

17. Vacuum drying machine according to claim 15, wherein an electric safety device is provided which comprises at least a vertical bar mounted to one of said uprights in facing spaced relationship with one toothed side of a vertical rack, said bar being spaced from said toothed side to allow the passage of one of said toothed wheels and said pinion, and further comprises an electric circuit coupled with said bar and one of said toothed wheel and said pinion to provide electric cut off upon irregular contact engagement between said bar and one of said toothed wheel and said pinion of one of said platforms.

18. Vacuum drying machine according to claim 15, wherein a mechanical safety device is provided which comprises at least a pair of metal bolts extending transversely of the opposite inner sides of said uprights and a pair of linear actuators coupled to said bolts to selectively and controllably move said bolts inwardly of said upright to allow free sliding of said platforms, or outwardly of said uprights to extend underneath of said platforms to prevent their accidental descent.

19. Vacuum drying machine according to claim 1, wherein said double-action cylinders comprise through stems extending substantially along the entire length of said vertical uprights, said stems having free ends respectively coupled to one of the top and the base of said vertical uprights by means of spherical joints.

* * * * *

UNITED STATES PATENT AND TRADEMARK OFFICE

CERTIFICATE OF CORRECTION

PATENT NO. : 5,056,239

DATED : October 15, 1991

INVENTOR(S) : Antonio Corner

It is certified that error appears in the above-identified patent and that said Letters Patent is hereby corrected as shown below:

On the Title Page, Item[57]:

In the Abstract, at lines 8-9, delete the words "is characterized in that" and add the word -- has --.

In the Specification, column 1, line 31, after the word "heated", add the word -- up --;

column 1, line 33, substitute the word "aspiration" with the word -- suction -- column 1, line 35, after the words "platforms and", add the word -- possibly --;

column 3, line 12, substitute the words "characterized in that" with the word -- wherein --;

column 4, line 7, substitute the words ", applied to the" with the words -- at the lower face thereof --;

column 9, line 32, after the words "said at least one pair of cylinders" add the word -- being --;

column 10, line 4 after the word "cylinders", add the words -- which are --;

column 11, line 3, after the word "bolts", add the word -- either --.

Signed and Sealed this

Nineteenth Day of April, 1994

*Attest:*

*Attesting Officer*

Bruce Lehman

BRUCE LEHMAN

*Commissioner of Patents and Trademarks*